United States Patent [19]

Oliver, Jr.

[11] 4,045,977

[45] Sept. 6, 1977

[54] SELF OPERATING EXCESS REFRIGERANT STORAGE SYSTEM FOR A HEAT PUMP

[75] Inventor: James W. Oliver, Jr., Staunton, Va.

[73] Assignee: Dunham-Bush, Inc., West Hartford, Conn.

[21] Appl. No.: 721,928

[22] Filed: Sept. 9, 1976

[51] Int. Cl.[2] ..... F25B 13/00

[52] U.S. Cl. ..... 62/324

[58] Field of Search ..... 62/324

[56] References Cited

U.S. PATENT DOCUMENTS

| | | | |
|---|---|---|---|
| 3,264,837 | 8/1966 | Harnish | 62/324 |
| 3,552,140 | 1/1971 | Palmer | 62/324 |
| 3,938,349 | 2/1976 | Ueno | 62/324 |

*Primary Examiner*—Lloyd L. King
*Attorney, Agent, or Firm*—Sughrue, Rothwell, Mion, Zinn and Macpeak

[57] ABSTRACT

Excess refrigerant is collected within a refrigerant pot surrounding a portion of the return conduit connecting the outdoor coil operating as an evaporator during a heat pump heating cycle to the compressor creating a reduced pressure temperature relationship within the pot cavity causing the migration of liquid refrigerant through a small diameter tube connecting the pot to the liquid line leading from the indoor coil to the outdoor coil at a point upstream of the outdoor coil expansion valve.

2 Claims, 3 Drawing Figures

SELF OPERATING EXCESS REFRIGERANT STORAGE SYSTEM FOR A HEAT PUMP

BACKGROUND OF THE INVENTION

1. Field of the Invention

This invention relates to heat pumps and more particularly to a system for removing excess liquid refrigerant from the closed loop system during heat pump heating mode.

2. Description of the Prior Art

Heat pumps comprise closed loop refrigeration systems in which one heat exchanger is positioned within a closed chamber such as a building structure or the like to be conditioned, and the other heat exchanger is positioned external of that building normally in the ambient, and wherein the two heat exchangers are connected in a closed loop conduit system which includes a compressor and a reversing valve for reversing the direction of flow of the refrigerant between heat exchangers depending upon whether the system is in the cooling or heating cycle for the building structure. The amount of refrigerant such as Freon needed for the closed loop system is usually determined by the requirements of the cooling cycle. That is, a reduced amount of refrigerant charge is required during the heating cycle, and the excess charge collects as liquid refrigerant within the indoor coil which functions as a condenser during the heating cycle. With outdoor ambient conditions approaching 70° F, the indoor coil containing excess refrigerant becomes too small, resulting in excessively high discharge temperature and pressure.

SUMMARY OF THE INVENTION

The present invention is directed to a heat pump which incorporates within the closed loop system means for automatically effecting the removal of excess refrigerant from the closed refrigerant loop to permit the indoor coil to operate at an acceptably low discharge temperature and pressure in heating mode.

Specifically, in a heat pump system including an outdoor coil, an indoor coil, a compressor, a reversing valve, expansion valve means for respective coils and conduit means defining a closed loop with said indoor coil and outdoor coil in series and said reversing valve connected across the compressor to direct compressed refrigerant gas selectively to change the direction of refrigerant flow between the indoor coil and the outdoor coil to cause said coils to function respectively as the condenser and evaporator for closed loop refrigeration circuit and the vice versa, the improvement comprising a refrigerant pot surrounding a first conduit means between the outdoor coil and the reversing valve, and wherein a small diameter bleed tube fluid connects a second conduit means leading from the indoor coil to the outdoor coil upstream of the expansion valve associated with the outdoor coil, whereby during the heating mode, the cold refrigerant return through the first conduit means within the refrigerant pot causes the refrigerant vapor within the refrigerant pot to condense resulting in reduced pressure therein causing a portion of the refrigerant within said second conduit means to migrate into the pot and to be maintained therein until cycle reversal of the heat pump system. The refrigeration pot may comprise a cylinder of a diameter substantially larger than the diameter of the first portion of said conduit means, end caps at respective ends of the cylinder sealed to said cylinder and to said conduit means, and wherein one end of said small diameter bleed tube is sealably connected to said cylinder and opening into the interior thereof.

DESCRIPTION OF THE PREFERRED EMBODIMENT

Figure 1:
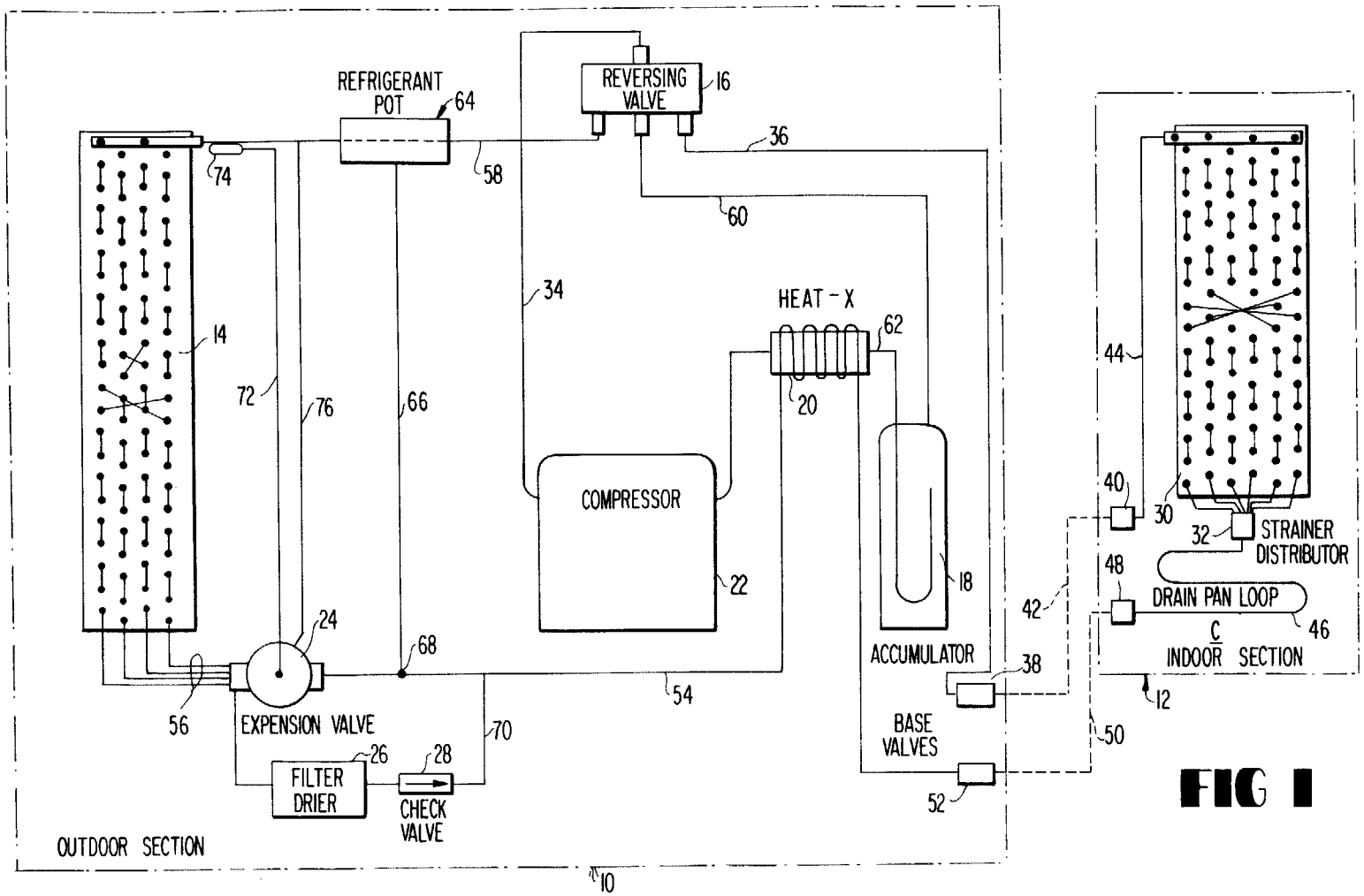
FIG. 1 is a schematic diagram of an improved heat pump system of the present invention incorporating the excess refrigerant storage system of the present invention.

Reference to FIG. 1 discloses a typical heat pump heating and cooling system to which the present invention has application. In that regard, the heat pump system comprises two sections, an outdoor section 10 and an indoor section 12, the indoor section being conventionally employed for heating and cooling a building structure or the like having an indoor coil 30 which constitutes the significant system component within indoor section 12. The outdoor section 10 may have all its components housed within a metal cabinet or the like and comprises essentially an outdoor heat exchanger or coil 14, a reversing valve 16, an accumulator 18, a subcooler 20, a compressor 22, and an expansion valve 24. Additional components comprise a filter dryer 26 and a check valve 28, bypassing expansion valve 24. The compressor 22 functions to compress refrigerant such as Freon 22, the compressor 22 discharging the refrigerant in the form of high pressure refrigerant vapor which passes through line 34 to reversing valve 16. The reversing valve 16 is conventional and simply controls the operation of the system in either a heating mode or cycle or a cooling mode or cycle. During the heating mode, the indoor coil 30 becomes the condenser for the closed loop refrigeration system, and the outdoor coil 14 becomes the evaporator. By reversing the fluid connections for the system, reversing valve 16 causes the outdoor coil 14 to act as the condenser and the indoor coil 30 to act as the evaporator, thereby removing heat from chamber C to be conditioned instead of adding heat thereto. The system is illustrated as operating in the heating mode or heating cycle, and in that case, the reversing valve 16 causes the high pressure vaporized refrigerant to pass from the reversing valve 16 through line or conduit 36 to a base valve 38 within the heat pump outdoor section 10. The hot compressed refrigerant vapor passes to the indoor section base valve 40 by way of connection passage 42. The high pressure, high temperature refrigerant vapor continues to the coil 30 via conduit or line 44. The refrigerant vapor condenses to a liquid at relatively high pressure within the heat exchanger 30 which is functioning as a condenser and causes heat to be given up to the air to be conditioned within chamber C. Liquid refrigerant accumulates within the bottom of the indoor coil 30 while employed as a condenser in this cycle, and passes by way of the strainer distributor 32 and the drain pan loop 46 to base valve 48 for return to the outdoor section base valve 52 by way of passage 50. Conduit or line 54 leading from the base valve 52 of the outdoor section causes the liquid refrigerant to pass through the coil of a subcooler or heat exchanger 20 in which the temperature of the liquid refrigerant is further reduced prior to the liquid refrigerant being expanded at expansion valve 24 within line or conduit 54 just upstream of the outdoor coil 14 which functions as an evaporator under the heating mode or cycle. A plurality of small diameter tubes 56 cause the refrigerant to enter the heat exchanger or outdoor coil 14 for expansion therein absorbing heat from the atmosphere. Relatively cool, low pressure refrigerant in vapor form is returned to the suction side of compressor 22 via return line or conduit 58 which is selectively connected to conduit or line 60 by reversing valve 16, causing the refrigerant to accumulate within accumulator 18. The accumulator 18 functions to insure that only refrigerant in vapor form passes through the subcooler or heat exchanger 20 for return to the suction side of compressor 22 via conduit or line 62. The refrigerant vapor returning to the suction side of the compressor is further heated by the subcooler, while as stated previously, the liquid refrigerant being directed to expansion valve 24 is subcooled in the process.

The system further includes a fluid bypass which includes a filter dryer 26 and a check valve 28 which permits refrigerant to flow unidirectionally from a point in the closed loop system between the expansion valve 24 and the outdoor coil 14 to line 54 between the same expansion valve 24 and the indoor coil, bypassing expansion valve 24, but not in a reverse direction. Further, in conventional fashion, the expansion valve 24 is controlled by a temperature responsive bulb 74 through line 72, bulb 74 sensing the temperature of the refrigerant returning to the compressor from the discharge side of the outdoor coil 14. Expansion valve 24 is also responsive to the pressure of that refrigerant by way of a pressure compensation line 76 which opens directly to conduit 58 and is connected at its other end to expansion valve 24. The heat pump system as described above is conventional.

In operation during the heating mode, the compressor 22 discharges refrigerant vapor at relatively high pressure and temperature, the hot vapor condensing within the indoor coil 30. The condensed high pressure liquid refrigerant passes from the indoor coil 30 by way of conduit 54 within the outdoor section and through the subcooler to the expansion valve 24 where its pressure is reduced. As the refrigerant expands and vaporizes, it picks up heat from the atmosphere. The relatively cool vaporized refrigerant passes through return conduit 58 to the suction side of the compressor via reversing valve 16 and conduit 60, subcooling refrigerant within line 54 at subcooler coil 20.

During the heating mode, since the quantity of refrigerant needed is considerably less than that needed during the cooling cycle, there is a tendency for excess liquid refrigerant to accumulate within the bottom of the indoor coil 30. Particularly when the outdoor ambient conditions approach 70° F, the available surface area of indoor coil 30 becomes too small for heat exchange in terms of its capacity due to condensed refrigerant, resulting in excessively high discharge temperature and pressure for the refrigerant within the closed loop system.

Figure 2:
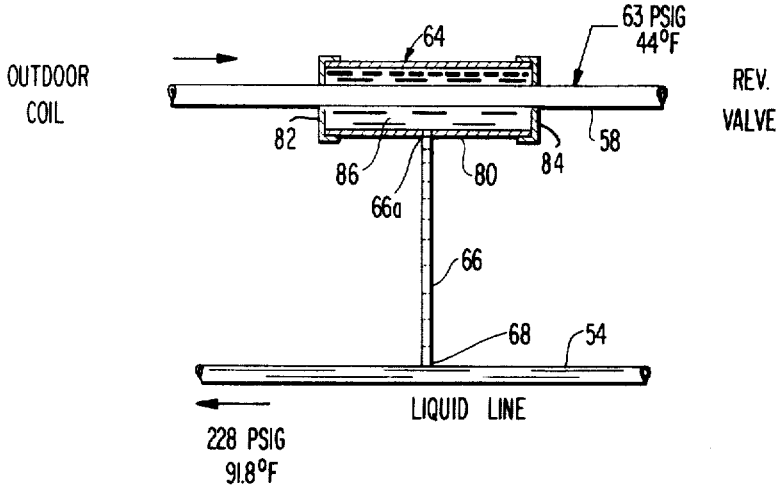
FIG. 2 is an enlarged, sectional view of a portion of the heat pump system of FIG. 1 illustrating the refrigerant pot during system heating mode.

The present invention is directed to a modification of the heat pump system in an inexpensive but highly effective manner for automatically removing the excess refrigerant from the closed loop, that is, between the two coils 14 and 30. A refrigerant pot indicated generally at 64 acts to store this excess refrigerant, the pot comprising a large diameter tube or cylinder 80, FIG. 2, which is capped at its ends by end caps 82 and 84, respectively. The end caps are apertured at their centers to permit the return conduit 58 to pass therethrough such that cylinder 80 concentrically surrounds a portion of the return conduit 58. The end caps 82 and 84 are sealed to the ends of cylinder 80 and to the return conduit 58 to form a chamber or cavity 86 of appreciable volume. A small diameter bleed line or tube 66 terminates at one end **66*a* within the sidewall of the cylinder 80; that end 66*a* of the tube 66 opening to chamber 86. The opposite end of tube 66 is fluid connected to the closed loop refrigerant line 54 leading from the indoor coil 30 to the outdoor coil 14, at a point 68, upstream of expansion valve 24. Thus, the refrigerant pot 64 is physically situated within the system between the reversing valve 16 and the outdoor coil 14. During the heating cycle, as illustrated in FIG. 2, the conduit 58 constitutes a return line or cold suction line to the compressor 22 through conduit 60 by way of reversing valve 16 so that relatively cool refrigerant returning through line 58 to the compressor, causes any refrigerant vapor within chamber or cavity 86 of the refrigerant pot 64 to condense, this resulting in a reduced pressure within chamber 86 which is transmitted via the small diameter bleed line 66 to conduit 54 forming the liquid supply line feeding the outdoor coil 14 acting as an evaporator in this mode. The low temperature and reduced pressure within chamber 86 causes the migration of liquid refrigerant into the pot, filling chamber 86 and holding the refrigerant there until the cycle is reversed. Thus, during the heating cycle, FIG. 2, the pot cavity 86 of container 80 will assume the temperature of the gas in tube 58. The expansion valve 24 metering liquid refrigerant to the outdoor coil 14 results in a solid wall of liquid refrigerant being backed up through the entire liquid line 54 until the liquid refrigerant actually accumulates in the lower portion of the indoor coil 30. With the employment of the refrigeration pot 64, at the temperature indicated, FIG. 2, pot 64 can absorb 78.77 pounds of liquid per cubic foot of space. Since liquid refrigerant will move to the coldest spot it can find, it will thus migrate to the pot 64 from line 68 through the small diameter tube 66 filling it and remain out of the main closed loop of flowing refrigerant. When the cycle is reversed, FIG. 3, the reversing valve 16 functions to connect the hot discharge line or conduit 34 to conduit 58, the passage of hot discharge gas within line 34 causes the liquid refrigerant which had been stored within chamber 86 to vaporize and to be driven back into the system through bleed line 66 into conduit 54. The diameter of cylinder 80 and its length and therefore the size of the refrigerant pot chamber 86** is set to accept whatever quantity of refrigerant it is desired to remove from the system during the heating cycle.

Figure 3:
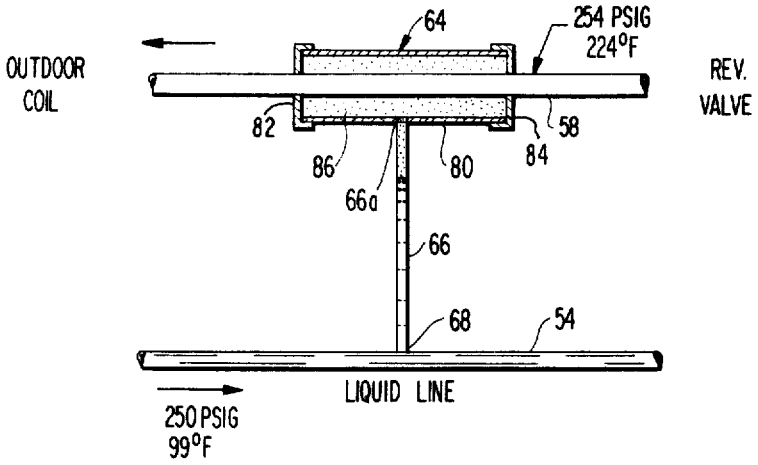
FIG. 3 is a similar enlarged, sectional view of a portion of the heat pump system corresponding to FIG. 2 but operating under the system heating mode.

At the temperature indicated in FIG. 3, the liquid refrigerant within the pot 64 during the heating cycle can no longer remain in a liquid state, but must change to gas or vapor, which volume is approximately 3.6 pounds per cubic foot, and the pot 64 will retain only a minute part of the system charged in the form of a gas with the liquid being absorbed back into the closed loop of flowing refrigerant.

While the illustrated embodiment employs an expansion valve, a capillary tube may be employed as a metering device on a heat pump which is sized for cooling on the basis of length, bore, and the amount of system refrigerant charge. When the heat pump thus equipped is in the heating mode, it is necessary to provide an additional restriction which is commonly done. The charge is just too large for the low loading and will flood back to the compressor if additional restriction is not provided. The pot of the illustrated embodiment may be readily added to such a heat pump system incorporating capillary tubing as the metering device instead of the expansion valve and will act identically to the system of FIG. 1 to remove refrigerant from the closed loop and allow for the use of a single capillary tube for both heating and cooling modes. Thus, it is intended that the present invention have equal application and that the claims cover such obvious variations, where capillary tubes are used in lieu of expansion valves for both the indoor and outdoor coils.

While the invention has been particularly shown and described with reference to a preferred embodiment thereof, it will be understood by those skilled in the art that various changes in form and details may be made therein without departing from the spirit and scope of the invention.

What is claimed is:

1. In a heat pump closed loop refrigeration and heating system including an indoor coil, an outdoor coil, a compressor and conduit means connecting the indoor coil and the outdoor coil in series and defining a closed loop, a mass of refrigerant within said closed loop, a compressor for compressing the refrigerant, and a reversing valve within said closed loop for reversing the direction of flow of refrigerant between said indoor and outdoor coils, and expansion means for said coils to permit one of said coils to selectively act as an evaporator coil and the other as a condenser and vice versa, the improvement comprising:

a refrigerant pot surrounding a portion of said conduit means connecting said outdoor coil and said reversing valve and forming a closed chamber in heat exchange relation to said conduit means, and a small diameter bleed tube connecting said refrigerant pot to said conduit means connecting said indoor coil to said outdoor coil at a point upstream of said expansion means;

whereby, during the heating cycle, relatively cool refrigerant passing from said outdoor coil to said reversing valve through said conduit means within said refrigerant pot causes condensation of refrigerant vapor within said chamber to reduce the chamber pressure such that liquid refrigerant migrates from said conduit means through small diameter bleed tube to said chamber thereby removing excess condensed refrigerant from said system.

2. The heat pump system as claimed in claim 1, wherein said refrigerant pot comprises a cylinder of a diameter substantially larger than that of said conduit means, said cylinder concentrically surrounds said conduit means, end caps are sealably mounted to respective ends of said cylinder and sealed to said conduit means extending therethrough and wherein said small diameter bleed tube is sealably mounted to the side of said cylinder and opens to said chamber.

* * * * *